United States Patent [19]

Olivieri

[11] 4,090,278

[45] May 23, 1978

[54] LACING DEVICE FOR SKI BOOTS

[75] Inventor: Icaro Olivieri, 10, Via Feltrina Nord, Montebelluna, Italy, 31044

[73] Assignees: Icaro Olivieri; C. Minuterie Metalliche S.p.A., both of Montebelluna, Italy

[21] Appl. No.: 821,556

[22] Filed: Aug. 3, 1977

[30] Foreign Application Priority Data

Aug. 12, 1976 Italy ..... 12758 A/76

[51] Int. Cl.[2] ..... A43C 11/00; A43B 11/00

[52] U.S. Cl. ..... 24/70 SK; 36/50

[58] Field of Search ..... 24/69 SK, 70 SK, 71 SK, 24/73 SC, 81 SK, 68 SK; 36/117, 50

[56] References Cited

U.S. PATENT DOCUMENTS

| | | | |
|---|---|---|---|
| 3,956,796 | 5/1976 | Guolo | 36/50 X |
| 3,967,391 | 7/1976 | Kastinger | 36/50 |
| 4,011,634 | 3/1977 | Olivieri | 24/70 SK |
| 4,020,571 | 5/1977 | Olivieri | 36/50 |

*Primary Examiner*—Louis K. Rimrodt

*Attorney, Agent, or Firm*—Marvin Feldman; Stephen E. Feldman

[57] ABSTRACT

A lacing device for ski boots comprises a hooked lever-like lacing member provided on one flap of the boot which cooperates with a ring-like lacing member provided on the other flap of the boot. The hooked lever-like lacing member is hingedly mounted on a carrier plate which is provided with an aperture presenting such a contour as to pass snugly over the enlarged head portion of an anchoring projection obtained on the ski boot flap. The carrier plate is then locked in place by means of a locking bolt, in the form of a small plate hingedly mounted on the carrier plate, which engages one of the recessed portions which form the enlarged head of the anchoring projection. In this manner, the aperture of the carrier plate is practically restricted in its area, and the carrier plate (and lever-like lacing member carried thereby) is secured to the ski boot flap.

5 Claims, 7 Drawing Figures

LACING DEVICE FOR SKI BOOTS

BACKGROUND AND SUMMARY OF THE INVENTION

The present invention relates to a lacing device for ski boots, and more particularly to novel means for anchoring one of the two members composing the said lacing device to the ski boot.

The modern ski boots are provided with a number of lacing devices each comprising a hooked lever-like lacing member cooperating with a ring-like lacing member. The said members are usually fastened to base plates, which in turn are secured, usually by means of rivets, to the ski boot upper, at both sides of the longitudinal opening defined by the two flaps of the ski boot upper.

According to U.S. Pat. Nos. 4,011,634 (patented Mar. 15, 1977) and 4,020,571 (patented May 3, 1977) both in the name of the same applicant as in the present invention, means have been proposed for easily mounting and disassembling the lacing members on the ski boot upper, by providing on the said upper suitable shaped anchoring projections onto which there may be secured, with a snap fit or with a sliding fit, elements for hingedly supporting and anchoring to said projections the lacing members.

The object of the present invention is to provide novel means for anchoring to the ski boot upper the hooked lever-like lacing member of the lacing device.

According to the present invention, the lever-like lacing member is hingedly mounted on a carrier plate which is provided with an aperture presenting such a contour as to pass snugly oer the enlarged head portion of the anchoring projection obtained on the ski boot flap. More precisely, the enlarged head portion is obtained by providing the anchoring projection with a pair of opposed grooved or recessed portions. Once that the carrier plate has been passed over the mentioned enlarged head portion, a locking bolt is inserted, which engages one of the said grooved or recessed portions of the anchoring projection, practically restricting the area of the aperture of the carrier plate and therefore locking the said carrier plate to the anchoring projection. The locking bolt may be constructed as a small plate hingedly mounted on the carrier plate, or as a slide bolt which is guided in suitable guide slots provided in the carrier plate. According to another embodiment, the locking bolt may be constructed as a U-shaped plate, having two legs or shanks which engage both recessed portions of the enlarged head of the anchoring projection.

BRIEF DESCRIPTION OF THE DRAWINGS

Further objects and advantages of the lacing device according to the invention will appear evident from the following specification made with reference to the accompanying drawings, in which.

DESCRIPTION OF THE PREFERRED EMBODIMENT

Figure 1:
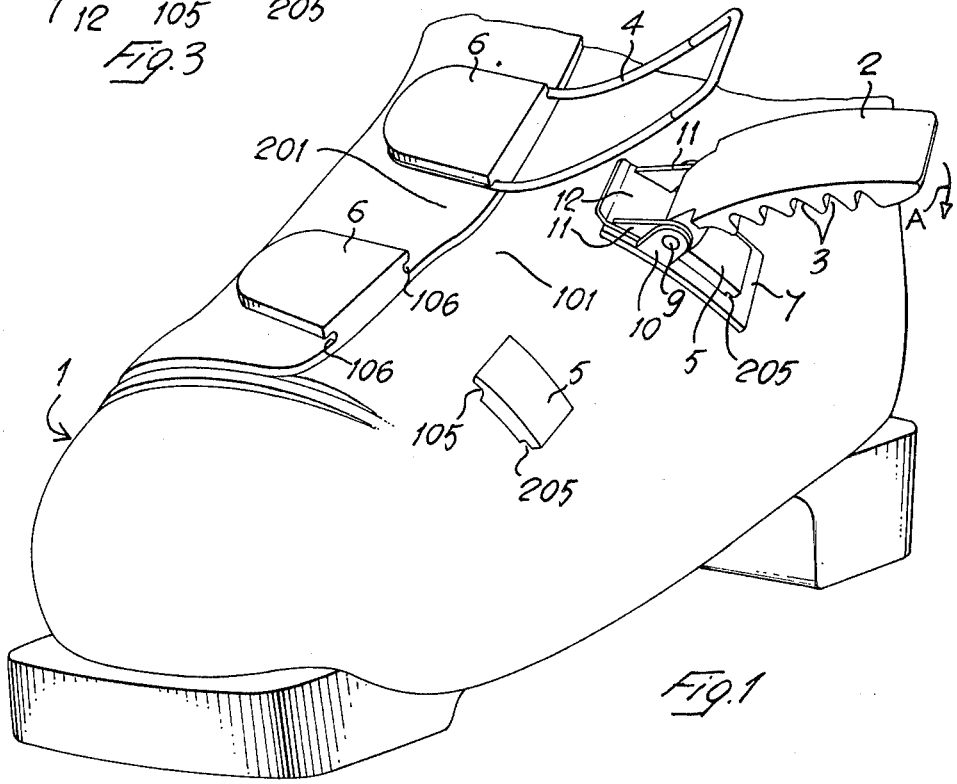
FIG. 1 is a perspective view of the broken away front portion of a ski boot provided with a lacing device according to the invention.

With reference to the drawings, reference numeral 1 indicates a ski boot made of plastic material. The ski boot upper is provided, in a conventional manner; with two flaps 101, 201. To the said flaps there must be anchored, or anyhow secured, the lacing devices which are of the conventional type comprising a lever-like lacing member 2 provided with hook indentations 3 on one flap 101, intended to cooperate with a ring-like lacing member 4 on the other flap 201. The lacing of the two flaps of the boot is effected by bringing the ring-like lacking member 4 into engagement with one hook indentation 3 of the lever-like lacing member 2 and by swinging the said lever-like lacing member 2 in the direction of arrow A (FIG. 1).

In order to removably secure to the flaps the lacing members, on the said flaps there are provided the anchoring projections 5 (on flap 101) and 6 (on flap 201). In the embodiment shown the said anchoring projections 5, 6 are made of one piece with the ski boot upper, preferably at the moment of the molding of the upper itself. The ring-like lacing member 4 is secured in any known manner to the projection 6 of flap 201, which projection for example presents a suitable peripheral groove 106 to be engaged by the rear portion of the ring-like lacing member 4.

The anchoring projection 5, which serves for the anchoring of the lever-like lacing member 2 presents a substantially guadrangular shape, and is provided with two grooves or recessed portions 105 and 205, respectively in correspondence of the front and of the rear side, the term "front" being used to indicate a side or portion which is located next to the longitudinal opening defined by the flaps, while the term "rear" is used to indicate a portion which is farther from said opening. As it may be better appreciated from FIG. 3, the said two recessed portions 105 and 205 define, in section, an enlarged head portion on the anchoring projection 5.

The lever-like lacing member 2 is hingedly mounted on a carrier plate 7. The said carrier plate 7 presents a quadrangular aperture 8 having such a contour so as to pass snugly over and beyond the mentioned enlarged head portion of projection 5. The carrier plate 7 presents two upwardly directed side lugs 10 for accomodating a transverse pivot pin 9 which serves for hingedly connecting the lever-like lacing member 2 to the plate 7. On the same pivot pin 9 there is hingedly mounted, by means of side lugs 11, a locking member or bolt 12 in the form of a small plate.

In order to secure the plate 7 (and lacing member 2 carried thereby) to the anchoring projection 5, the said plate 7 is fitted over the said projection, so that its aperture 8 passes over the enlarged head portion of the projection itself. The locking bolt 12 (see FIG. 2, full lines, and FIG. 3, dash-and-dot lines) will be in its lifted unoperative position. Thereafter, the locking bolt 12 is swung downwardly (see arrow B, FIG. 3) in its engaging position so that its free edge engages the front recess 105, as clearly illustrated by full lines in FIG. 3. In this manner, the edge of the said locking bolt 5 inserts itself between the underside of the enlarged head of the projection and the upper side of the carrier plate 7. At the same time, the movement of the locking bolt 12 promotes the sliding of the carrier plate 7 on flap 101 towards the front of the flap, so that the rear side of the aperture 8 of the carrier plate 7 engages the rear recessed portion 205 of the projection 5. It will be appreciated that in this manner a safe and reliable anchoring of plate 7 (and of lacing member 2 carried thereby) on projection 5 of flap 101 is obtained. Practically, the anchoring is obtained by reducing the area of the aperture 8 of the plate 7, after having passed the said plate over the enlarged head portion of the projection 5. When required, the plate 7 may be unlocked and removed, by simply swinging upwardly the locking bolt 7 and again bringing the aperture 8 to its "full area" condition.

MODIFICATIONS

Figure 4:
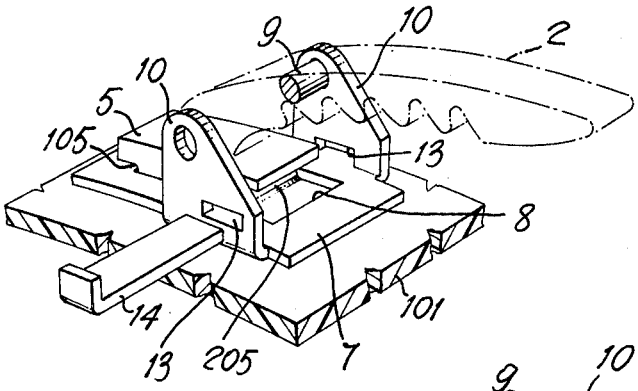
FIGS. 4 and 5 show in perspective view another embodiment of the lever-like lacing member of the lacing device according to the invention, respectively in its unlocked and locked position with respect to the anchoring projection.
Figure 5:
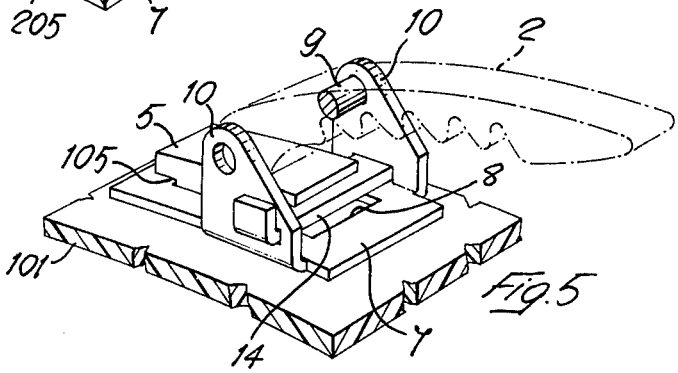

According to the embodiment shown in FIGS. 4 and 5, the carrier plate, fitted over the anchoring projection 5, is locked in place by a bolt bar 14 (in the form of a small plate) which is slidably introduced into the guide slots 13 provided in the upwardly directed lugs 10 of the carrier plate 7, said bolt bar 14 engaging with its edge the rear groove or recessed portion 205 of the anchoring projection.

Figure 6:
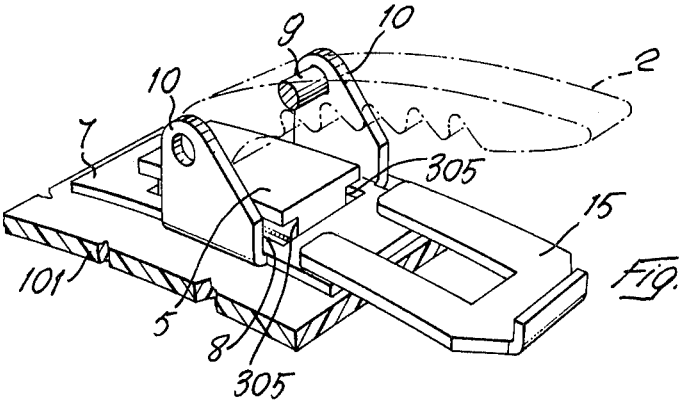
FIGS. 6 and 7 show in perspective view still another embodiment of the lever-like lacing member of the lacing device according to the invention, respectively in its unlocked and locked position with respect to the anchoring projection.
Figure 7:
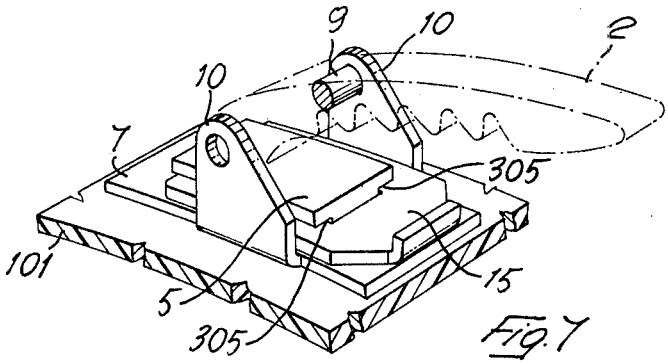

In the embodiment shown in FIGS. 6 and 7 it is to be particularly noted that the anchoring projection 5 presents two grooves or recessed portions 305 on its transversal sides (i.e. the sides which are perpendicular to the opening defined by the flaps 101 and 201). The locking member or bolt for locking in place the plate 7 passed over the said projection 5, consists of a U-shaped plate 15 which presents two shanks or legs. As it appears evident from the Figures, the locking bolt 15 is slidably fitted in such a manner as to cooperate with its legs with the underside of the enlarged head of the projection 5 and with the upper side of the plate 7.

Figure 2:
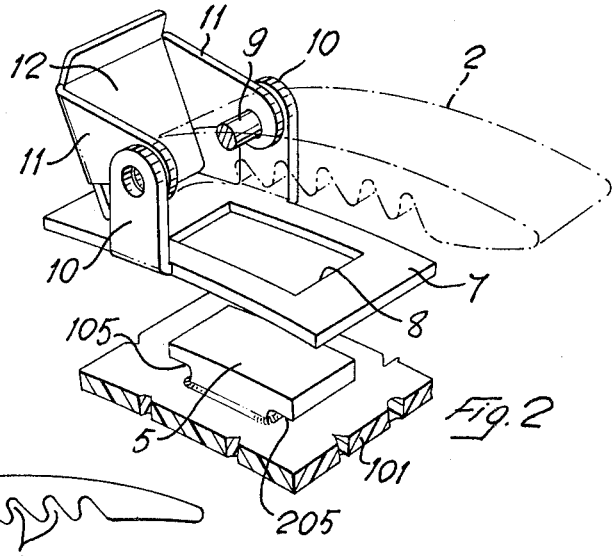
FIG. 2 is a perspective view showing an enlarged detail of the lever-like lacing member of the lacing device, disassembled from the ski boot.
Figure 3:
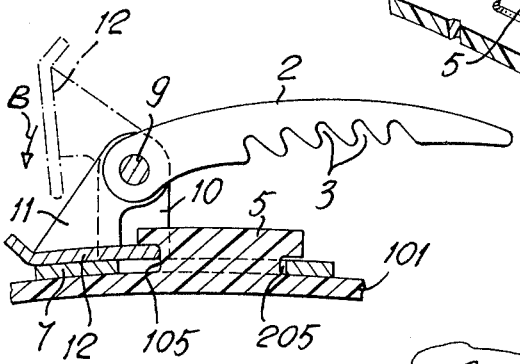
FIG. 3 is a side section showing the lacing member secured to the ski boot anchoring projection.

As already mentioned in connection with FIGS. 1 to 3, it is to be noted that practically the anchoring of plate 7 onto projection 5 is obtained by causing the said plate to pass with its aperture 8 over the projection 5, and then by reducing the area of said aperture 8 with the insertion of a locking member in the form of a locking bolt which is inserted between the said plate and the enlarged head portion provided on said anchoring projection.

It is believed that the invention will have been clearly understood from the foregoing detailed description of some preferred embodiments of same. Changes in the details of construction may be resorted to without departing from the spirit of the invention, and it is accordingly intended that no limitation be implied and that the hereto annexed claims be given the broadest interpretation to which the employed language fairly admits.

I claim:

1. In a ski boot of the type comprising a ski boot upper provided with two flaps, a lacing device including a hooked lever-like lacing member provided on one flap and intended to cooperate with a ring-like lacing member on the other flap, anchoring means for securing at least one of said lacing members in a removable manner onto the corresponding flap, said anchoring means comprising:

(a) an anchoring projection provided on the flap and presenting on its periphery at least two opposed grooved or recessed portions, so as to form an enlarged head;

(b) a carrier plate onto which there is mounted the lacing member, said carrier plate presenting an aperture having such a contour as to pass snugly over the said enlarged head of the anchoring projection;

(c) a locking element to be inserted between the carrier plate and the enlarged head of the anchoring projection, said locking element presenting at least one part capable of engaging at least one of the said grooved or recessed portions of the anchoring projection, the insertion of said locking element practically restricting the area of the aperture of the carrier plate.

2. A lacing device according to claim 1, in which the locking member consists of a locking bolt hingedly mounted on the carrier plate.

3. A lacing device according to claim 2, in which the lacing member and the locking bolt are both hingedly mounted on the carrier plate on a common hinge axis.

4. A lacing device according to claim 1, in which the locking member consists of a locking slide bolt apt to be slidably inserted into guide slots provided on the carrier plate.

5. A lacing device according to claim 1, in which the locking member is constructed as a U-shaped plate having two shanks or legs, each of said shanks or legs engaging one of the opposed grooved or recessed portions of the anchoring projection.

* * * * *